US009974378B2

(12) United States Patent
O'Keeffe

(10) Patent No.: US 9,974,378 B2
(45) Date of Patent: May 22, 2018

(54) STYLIST UTILITY STAND AND METHOD FOR ERGONOMICALLY ASSISTING A STYLIST

(71) Applicant: Janice O'Keeffe, Sidney (CA)

(72) Inventor: Janice O'Keeffe, Sidney (CA)

( * ) Notice: Subject to any disclaimer, the term of this patent is extended or adjusted under 35 U.S.C. 154(b) by 0 days. days.

(21) Appl. No.: 15/232,369

(22) Filed: Aug. 9, 2016

(65) Prior Publication Data

US 2018/0027951 A1 Feb. 1, 2018

Related U.S. Application Data

(63) Continuation-in-part of application No. 15/222,897, filed on Jul. 28, 2016, now abandoned.

(51) Int. Cl.

| | |
|---|---|
| ***A45D 44/02*** | (2006.01) |
| ***A45D 44/14*** | (2006.01) |
| ***A47C 1/11*** | (2006.01) |
| ***A47C 1/06*** | (2006.01) |
| ***A47C 3/18*** | (2006.01) |

(52) U.S. Cl.

CPC ..... *A45D 44/02* (2013.01); *A45D 44/14* (2013.01); *A47C 1/06* (2013.01); *A47C 1/11* (2013.01); *A47C 3/18* (2013.01)

(58) Field of Classification Search

CPC ..... A45D 44/02; A45D 44/04; A45D 44/14; A47C 1/06; A47C 1/11; A47B 11/00

USPC ..... 108/42, 43, 48, 49, 92, 93, 94, 95; 248/188.2, 125.8, 346.01; 211/133.1, 211/133.3, 133.4, 85.13; 269/17

See application file for complete search history.

(56) References Cited

U.S. PATENT DOCUMENTS

| | | | | |
|---|---|---|---|---|
| 938,937 | A | 11/1909 | Aitken | |
| 1,674,116 | A * | 6/1928 | Lord | A47K 13/06 4/254 |
| 2,023,901 | A * | 12/1935 | Rhodes | A47K 17/028 4/254 |
| 2,112,669 | A | 3/1938 | Halas | |
| 2,306,294 | A | 12/1942 | Brown et al. | |
| 2,533,893 | A | 12/1950 | Nussbaum | |
| 2,649,144 | A | 8/1953 | Stephens | |
| 2,803,292 | A | 8/1957 | Nyberg | |
| 2,954,955 | A | 10/1960 | Feller | |
| 3,245,716 | A | 4/1966 | Danner | |
| 3,601,443 | A | 8/1971 | Jones | |
| 3,712,669 | A | 1/1973 | Cates | |
| 3,743,051 | A * | 7/1973 | Cramer | E06C 1/005 182/106 |
| 4,279,043 | A * | 7/1981 | Saunders | A61G 7/1038 280/87.041 |
| 4,372,605 | A | 2/1983 | Cervantes | |
| D306,397 | S * | 3/1990 | Kweon | D8/375 |
| 4,974,808 | A * | 12/1990 | Ball | A47B 21/00 108/93 |

(Continued)

*Primary Examiner* — Katherine W Mitchell
*Assistant Examiner* — Shiref M Mekhaeil
(74) *Attorney, Agent, or Firm* — Integrity Patent Group, PLC; Edwin Wold

(57) ABSTRACT

A stylist utility stand that includes means for vertically elevating a stylist, such as a hair stylist, and means for supporting stylist items proximate the stylist while elevated on the means for vertically elevating the stylist. In addition, the disclosed stylist stand may include means for inhibiting the stylist from inadvertently stepping off the stylist utility stand.

3 Claims, 5 Drawing Sheets

(56) References Cited

U.S. PATENT DOCUMENTS 5,080,192 A * 1/1992 Kerr ..... E06C 1/397 182/106
5,108,089 A * 4/1992 Wilkinson ..... A63B 23/0458 108/12
5,119,907 A * 6/1992 Billington, III ..... B66F 11/04 182/113
5,125,646 A * 6/1992 Wilkinson ..... A47B 9/14 248/188.2
5,127,647 A * 7/1992 Wilkinson ..... A63B 23/0458 108/12
5,158,157 A * 10/1992 Billington, III ..... B66F 11/04 182/113
5,217,090 A * 6/1993 Billington, III ..... B66F 11/04 182/141
5,454,771 A * 10/1995 Wilson-Hyde ... A63B 21/00047 248/240.4
5,461,736 A * 10/1995 Carpenter ..... B66F 5/04 182/141
5,584,779 A * 12/1996 Knecht ..... A63B 24/00 434/250
5,720,362 A * 2/1998 Denkins ..... B25H 1/04 182/182.2
5,833,028 A * 11/1998 Ramsey ..... E06C 7/48 182/108
6,132,338 A * 10/2000 Shifferaw ..... A63B 5/08 482/30
D483,084 S * 12/2003 Gvoich ..... D21/671
6,739,936 B1 * 5/2004 Cotilletta ..... A63H 3/50 248/125.8
6,823,805 B2 * 11/2004 Becker ..... A61B 46/10 108/103
6,926,643 B1 * 8/2005 Gvoich ..... A63B 23/0458 482/51
7,165,276 B2 * 1/2007 Hahn ..... A61G 7/1038 5/81.1 R
7,311,048 B2 * 12/2007 Kopala, Jr. ..... A47B 9/00 108/147
8,246,521 B2 * 8/2012 Alexander ..... A63B 5/00 482/142
8,490,747 B2 * 7/2013 Winslow ..... E04G 5/00 182/118
D698,163 S * 1/2014 Edwards ..... D6/349
8,657,069 B1 * 2/2014 Schwengels ..... A47C 12/02 182/223
2002/0027117 A1 * 3/2002 Brandenberg ..... A47B 9/14 211/205
2004/0178306 A1 * 9/2004 Hallberg ..... F16M 11/046 248/188.5
2011/0248531 A1 10/2011 Powell
2012/0061531 A1 * 3/2012 Ho ..... F16M 11/041 248/125.8
2013/0061781 A1 * 3/2013 Wong ..... B60N 3/002 108/3
2014/0238279 A1 * 8/2014 Maas ..... A47B 21/02 108/146
2015/0250674 A1 * 9/2015 Moore ..... A61G 7/1044 135/65
2016/0318176 A1 * 11/2016 Swisher ..... B25H 1/00
2016/0353862 A1 * 12/2016 Nance ..... A45D 44/02

* cited by examiner

STYLIST UTILITY STAND AND METHOD FOR ERGONOMICALLY ASSISTING A STYLIST

CROSS-REFERENCE TO RELATED APPLICATION

The present application is a continuation-in-part and is related to and claims priority from prior non-provisional utility patent application Ser. No. 15/222,897, filed Jul. 28, 2016 which application is incorporated herein by reference.

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. FIELD OF THE INVENTION

The present invention relates generally to the field of cosmetology tools, and more specifically relates to stylist utility tools.

2. DESCRIPTION OF RELATED ART

Cosmetologists and clients of cosmetologists come in all heights. Where the cosmetologist is "shorter" and the client is "taller" this can create challenges, particularly for hairstylists, whose "work area" is the highest part of the client. In particular, the stylist may be required to fully extend and reach over to access and view the clients head. Moreover, this may continue for extended periods. Moreover two persons of the same height may have a longer or shorter torso, further exacerbating the problem. While many stylists chairs are adjustable upward and downward, this is not always sufficient to accommodate all height discrepancies.

Prolonged working periods at an unnatural level can result in back, neck, shoulder, elbow, muscle, soft tissue, ligament, and tendon issues. Working at a 45 degree angle over a period of time can cause fatigue, and even injury. Moreover, a stylist may have the added weight of tools, such as blowers, or be required to constantly travel back and forth from a countertop to grab a specialty tools (e.g., water spray) in the middle of a particular step (e.g., cutting).

Several attempts have been made to solve the above-mentioned problems such as those found in U.S. Pat. No. 4,372,605 to Cervantes, U.S. Pat. No. 3,712,669 to Cates, U.S. Pat. No. 3,601,443 to Donald, U.S. Pat. No. 3,245,716 to Danner, U.S. Pat. No. 2,954,955 to Feller, U.S. Pat. No. 2,803,292 to Nyberg, U.S. Pat. No. 2,649,144 to Stephens, U.S. Pat. No. 2,533,893 to Nussbaum, U.S. Pat. No. 2,306,294 to Blechschmidt et al., U.S. Pat. No. 2,112,669 to Halas et al., U.S. Pat. No. 938,937 to Aitken, US Pat. App. Pub. No. US 2011/0248531 to Powell. This art is representative of accessories for beauty parlor chairs. However, none of the above references, taken either singly or in combination, is seen to describe the invention as claimed. Thus, a need exists for a reliable solution to avoid the above-mentioned problems.

BRIEF SUMMARY OF THE INVENTION

In view of the foregoing disadvantages inherent in the known cosmetology art, particular the hairstyling branch.

The present invention provides a novel utility stand. The general purpose of the present invention, which will be described subsequently in greater detail is to provide a utility stand.

A utility stand for a work area about a stylist chair is disclosed herein. The utility stand may include a platform configured to elevate a stylist vertically, when the stylist is in at least a portion of the work area around the stylist chair, and the utility stand further including a utility support configured to support one or more stylist items, and further configured to attach to the platform, such that the one or more stylist items are also supported by the platform.

According to one embodiment, a stylist utility stand is also disclosed herein. The stylist utility stand may include means for vertically elevating a stylist while in a work area about a stylist chair, means for inhibiting the stylist from inadvertently stepping off the means for vertically elevating a stylist, and means for supporting stylist tools and supplies proximate the stylist while elevated on the means for vertically elevating a stylist.

According to another embodiment, a method for ergonomically assisting a stylist is also disclosed herein. The method for ergonomically assisting a stylist may include the steps of elevating the stylist at least 6 inches vertically while in a working area, supporting stylist tools proximate the stylist while elevated, and inhibiting the stylist from inadvertently falling while elevated.

BRIEF DESCRIPTION OF THE DRAWINGS

The figures which accompany the written portion of this specification illustrate embodiments and methods of use for the presently disclosed stylist stand, constructed and operative according to the teachings of the present disclosure.

The various embodiments of the present disclosure will hereinafter be described in conjunction with the appended drawings, wherein like designations denote like elements.

DETAILED DESCRIPTION

Preferably, a stylist stand and method for assisting a stylist should provide elevation and tool support, and yet would, operate reliably and be manufactured at a modest expense. Thus, a need exists for a reliable stylist stand and method for assisting a stylist to avoid the above-mentioned problems.

As discussed above, embodiments of the present disclosure relate to a stylist stand and more particularly to a stylist stand that may be useful to improve the ergonomics and utility. The features of the disclosure that are believed to be novel are particularly pointed out and distinctly claimed in the concluding portion of the specification. These and other features, aspects, and advantages of the present invention will become better understood with reference to the following drawings and detailed description.

Generally, the disclosed stylist stand includes means for vertically elevating a stylist while styling/cutting hair, and means for supporting stylist tools proximate the stylist while elevated on the stylist stand. In addition, the disclosed stylist stand may include means for inhibiting the stylist from inadvertently stepping off the stylist stand. Additional features and configurations are contemplated as discussed further below.

Figure 1:
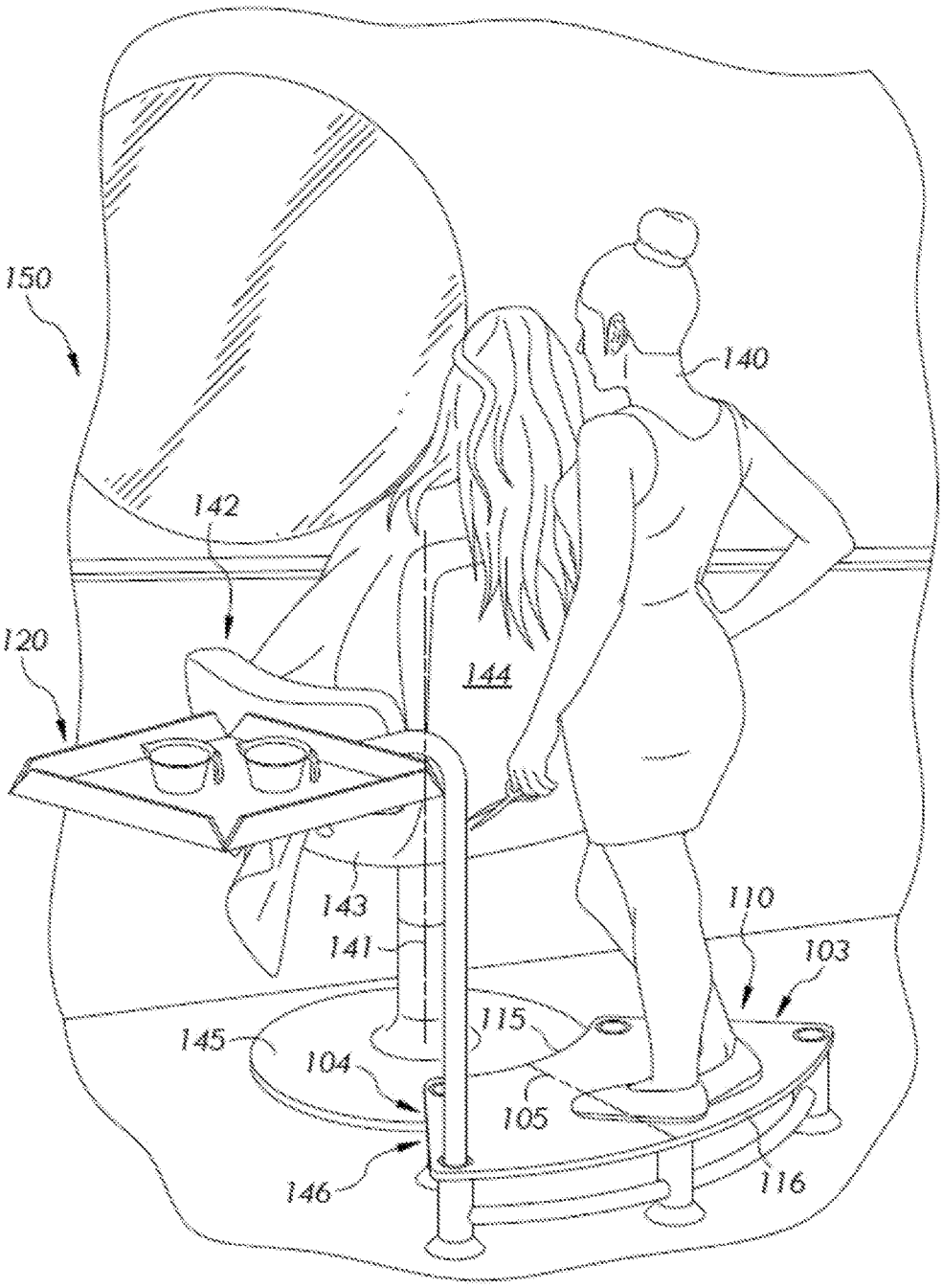
FIG. 1 is a perspective view illustrating a utility stand for a work area about a stylist chair during an 'in-use' condition, according to one exemplary embodiment.

FIG. 1 is a perspective view illustrating a utility stand for a work area about a stylist chair during an 'in-use' condition 150, according to one exemplary embodiment of the disclosure. Here, utility stand 100 is shown being used by a stylist 140 while cutting a client's hair. In particular, the utility stand 100 is shown including means for vertically elevating the stylist 110 and means for supporting stylist item proximate the stylist while elevated on the stylist stand 120. The stylist items may include consumables, tools, or any combination thereof. For example, the stylist items may include spray bottles, lotions, cleaners, etc. Also, for example, the stylist items may include powered tools/devices (e.g., blowers, clippers, etc.), unpowered devices (e.g., bowls, sprays, combs, scissors, files, etc.).

According to one embodiment, the means for supporting stylist item proximate the stylist while elevated on the stylist stand 120 may be configured as or include a tray, as illustrated, which may be useful for maintaining the stylist items (here, hair coloring bowls and coloring) in a desired orientation. According to another embodiment, the means for supporting stylist items proximate the stylist while elevated on the stylist stand 120 may include interfaces for specific equipment or devices. For example, where a stylist item includes a ring (or other hanging feature), the means for supporting stylist item proximate the stylist while elevated on the stylist stand 120 may be configured as or include a hook or other hanging interface. Many other interfaces are contemplated.

For convenience and ease of description, the present disclosure may reference aspects of a stylist chair 142. In particular, stylist chair 142 may include a seat 143, a back 144, a base 145, and a vertical or chair center axis 141. The chair center axis 141 may be substantially vertical and generally pass through the center of the seat 143 and the base 145 of the stylist chair 142. Where the stylist chair 142 rotates, the chair center axis 141 may also correspond to the axis of rotation of the seat 143 of the stylist chair 142. The base 145 may have an outer edge or perimeter. For example, here, as the base 145 is circular, the outer edge corresponds to a perimeter defined by a single radius.

For reference, relative to a view point of the stylist 140 towards the chair center axis 141 when standing on the utility stand 100, the standing surface (described below) of the utility stand 100 (as well as the utility stand 100 itself) may have a front edge 115 and a back edge 116, with the front edge 115 nearer to the chair center axis 141 than the back edge 116, when the utility stand 100 is positioned for use in the work area. Similarly, the utility stand 100 (as well as the standing surface of the utility stand 100) may have a right-hand-side 103 and a left-hand-side 104, separated by a centerline 105, where each of the right-hand-side 103 and the left-hand-side 104 extends between the front edge 115 and the back edge 116.

Accordingly, the stylist 140 may be have a generally understood work area sweeping around the chair center axis 141. Here, the work area may generally include the annular region extending from the outer edge of the base 145 and to an arms-length away. An arms-length will generally be less than four feet, but may be one to three feet, approximately two feet, approximately one and a half feet, or any combination thereof. "Approximately", as used herein may indicate 15%, 10%, or 5% off nominal. As such, the work area may be conveniently defined here as an annulus sharing its inner diameter with the outer edge of the base 145 and its width being arms-length, as described above. Alternately, the work area may be limited to an arc of the annulus, such as a 90 degree arc, a 180 degree arc, or a 240 degree arc, to name a few.

Figure 2:
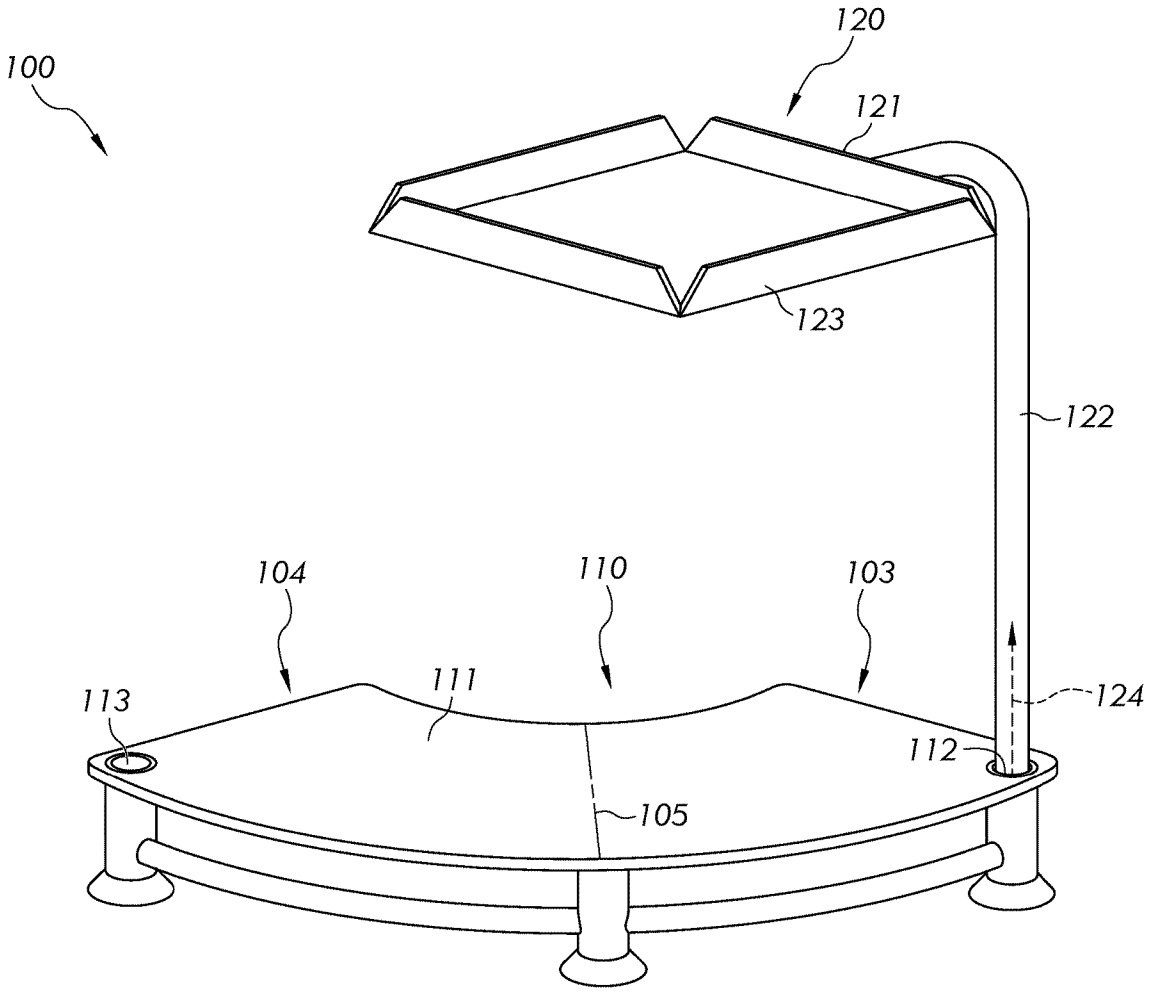
FIG. 2 is a perspective view illustrating the stylist stand of FIG. 1, according to one embodiment of the disclosure.

FIG. 2 is a perspective view illustrating a stylist stand of FIG. 1, according to one embodiment of the disclosure. As above, the utility stand 100 may include means for vertically elevating the stylist 110 and means for supporting stylist tools proximate the stylist while elevated on the stylist stand 120.

The means for vertically elevating the stylist 110 may include a platform 111 configured to elevate a stylist vertically, when the stylist is in at least a portion of the work area around the stylist chair. For example, the platform 111 may include a raised flat/horizontal walking area. The platform 111 may be made of metal, or other structural material, and be configured with sufficient strength to support continuous loadings of a person stepping up onto the platform, moving about, and remaining for extended periods of time. According to one embodiment, the platform 111 may be further configured to be lightweight. For example, the platform 111 may incorporate structural features such as trusses, gratings, or honeycomb to name a few. Also, for example, the platform 111 may be made, at least in part, with light materials, such as composites, alloys, or wood.

According to one embodiment, the platform 111 may further include added traction (no-slip) features (e.g., grip tape, carpeting, or matting) and/or integrated traction features (e.g., grating, perforations, or extrusions). The platform 111 may also include a step or other aid in getting from a ground level to the working level of the elevated platform 111.

The platform 111 may generally contour about the stylist's work area such as about the base of the stylist chair, as described above. In particular, the platform 111 may be configured to provide an elevated work area within the stylist's normal work area, or a portion thereof. For example the platform 111 may be include a sturdy, horizontal surface elevated about the ground that begins anywhere from the outer edge of the base of the stylist chair outward from its center. Preferably, the platform 111 will have a width corresponding to the arm-length of the stylist and an expected range where the stylist is expected to stand.

The means for supporting stylist tools proximate the stylist while elevated on the stylist stand 120 may include a utility support 121. The utility support 121 may be configured to support one or more stylist items, and further configured to attach to the platform 111, such that the one or more stylist items are also supported by the platform. For example, as illustrated, the utility support 121 may include a raised tray fixed to the platform 111.

According to one embodiment, the utility support 121 may include a support riser 122 and a stylist item support 123. In particular, the support riser 122 may include a vertical member coupled to the platform and configured to hold the stylist item support 123 at desired a utility elevation. Here, the support riser 122 is embodied as a 90 degree bent tube, having a vertical section and a horizontal section, and the stylist item support 123 is embodied as a sheet metal tray fixed to the horizontal portion of the 90 degree bent tube. According to one embodiment the tray may be approximately 10 inches by 12 inches, the 90 degree bent tube may have a 1 inch outer diameter.

According to one embodiment the utility support 121 may be movable. In particular, the utility support 121 may be moveable from a first position to a second position while coupled to the platform 111. For example, the utility support may be configured to rotate about a utility support vertical axis 124. Moreover, and as illustrated, the utility support vertical axis 124 may be independent of the chair center axis 141 (FIG. 1). As illustrated, the utility support vertical axis 124 may be coaxial or otherwise correspond to a tubular vertical axis of the vertical section support riser 122. In this way, the utility support 121 may be fixed in a horizontal plane, but free to rotate axially, and the means for supporting stylist tools proximate the stylist while elevated on the stylist stand 120 may be configured to rotate about the utility support vertical axis 124, the utility support vertical axis 124 passing through at least one point of the stylist stand. According to one embodiment, the utility support 121 may be configured to rotate at least 360 degrees about the utility support vertical axis 124.

According to one embodiment, the utility stand 100 may be made ambidextrous. In particular, the utility support 121 may be moveable from a first position proximate the right-hand-side 103 of the utility stand 100 to a second position proximate the left-hand-side 104 of the utility stand 100. For example, the platform 111 may include a right utility support interface 112 and a left utility support interface 113, with each configured to position the utility support 121 on the right-hand-side 103, and alternately, on the left-hand-side 104 of the centerline 105, respectively. The right utility support interface 112 and the left utility support interface 113 may be substantially identical, as both are configured to receive and laterally support the utility support 121. Moreover, the right utility support interface 112 and the left utility support interface 113 (along with the utility support 121) may be configured for toolless coupling and decoupling (e.g., detent pins, shear pins, slot locks, coaxial sleeves, etc.). In this way, the stylist may easily reconfigure the utility stand 100 by removing the utility support 121 from one of the right utility support interface 112 and the left utility support interface 113 and coupling it with the other of the right utility support interface 112 and the left utility support interface 113.

Figure 3:
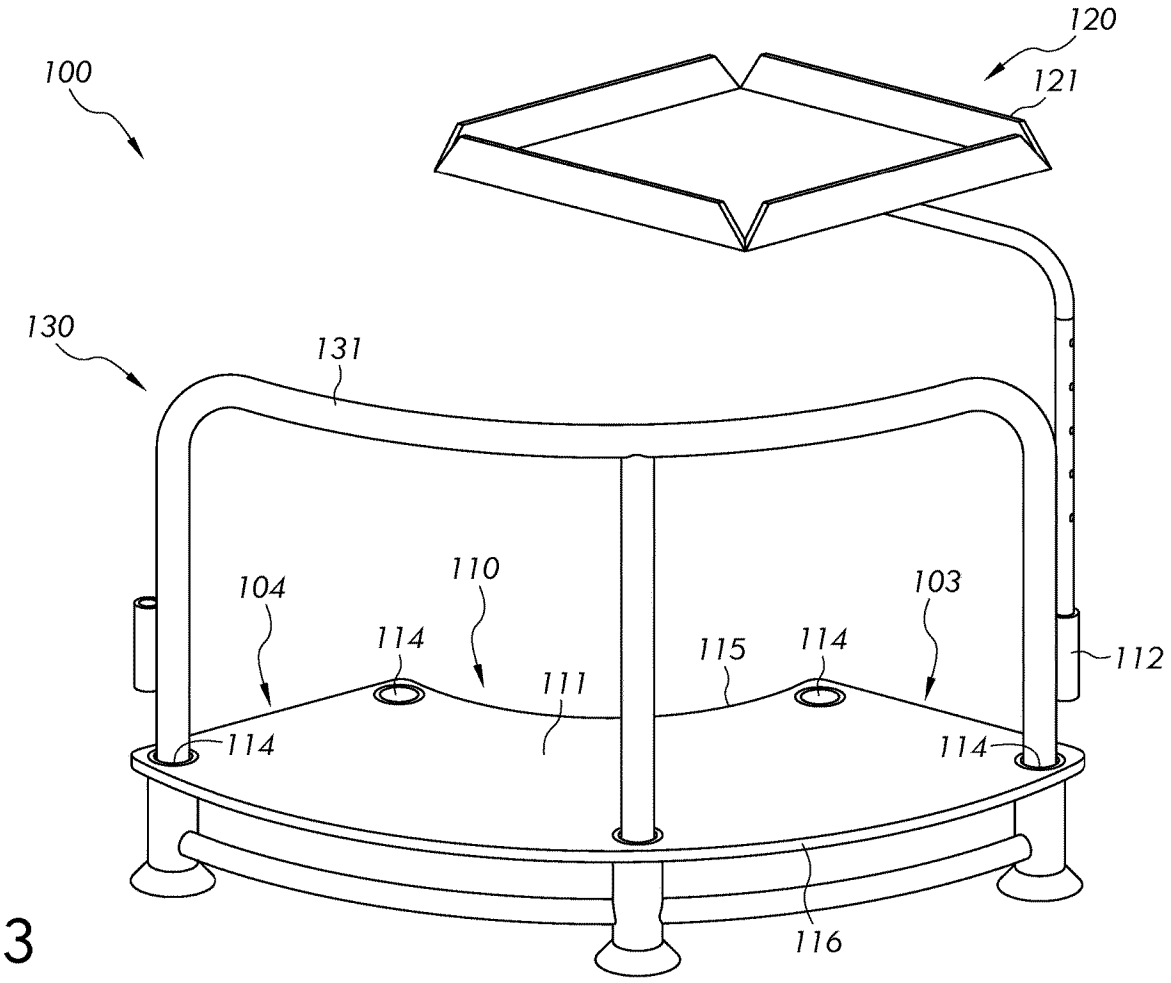
FIG. 3 is a perspective view illustrating a stylist stand including a rail, according to another embodiment of the disclosure.

FIG. 3 is a perspective view a stylist stand including a rail, according to another embodiment of the disclosure. As shown, the utility stand 100 may further include means for inhibiting the stylist from inadvertently stepping off the stylist stand 130. Here, the means for inhibiting the stylist from inadvertently stepping off the stylist stand 130 is configured as a back stop 131 (preventing or at least deterring or inhibiting the stylist from stepping off the back of the utility stand 100. In particular, here, the back stop 131 is coupled to the platform, and configured to deter the stylist from stepping off the back edge of the standing surface. This configuration may be particularly beneficial as it may protect the stylists' blind spot, while remaining lightweight. According to one embodiment the back stop 131 may be substantially made of 1.24 inch aluminum pipe.

In other embodiments, the means for inhibiting the stylist from inadvertently stepping off the stylist stand 130 may include back stop 131, or similarly, a front stop, a left stop, a right stop, and/or any combination thereof. In these embodiments the platform 111 may include a one or more platform interfaces 114 that are configured to receive or otherwise support the means for inhibiting the stylist from inadvertently stepping off the stylist stand 130. Notably here, the right utility support interface 112 may be integrated into the means for inhibiting the stylist from inadvertently stepping off the stylist stand 130 instead of the platform 111. According to one embodiment, the back stop 131 may extent upward to an elevation of at least 24 inches from the platform 111.

Additionally, the means for inhibiting the stylist from inadvertently stepping off the stylist stand 130 may further include a gate or other movable feature configured to securably provide access onto the platform. This may be particularly useful where more than one stop is used. As illustrated, the stops may be configured as affirmative stops blocking exit (here from the back), but also providing hand holds for added user support.

Figure 4C:
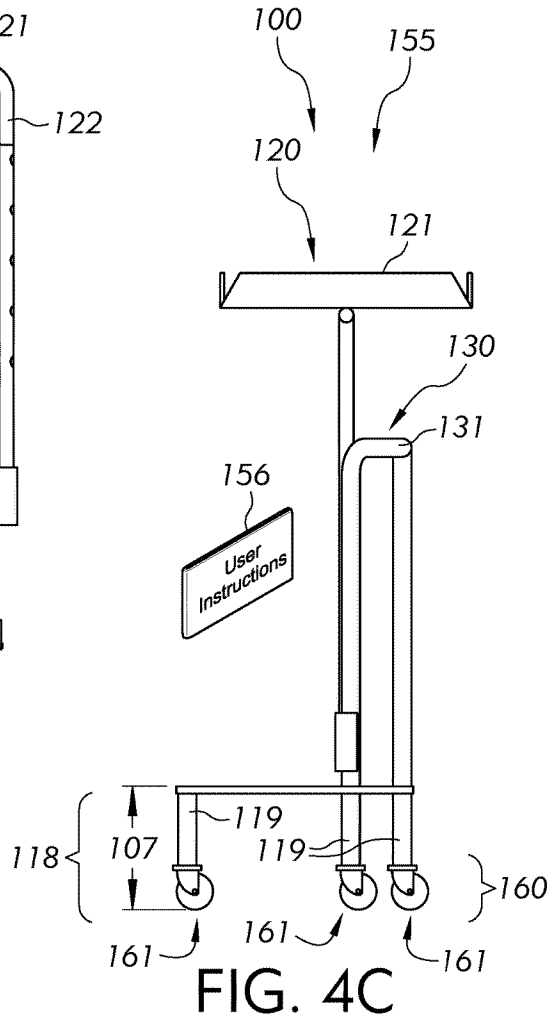
FIGS. 4A-4C show various dimensional views illustrating the utility stand of FIG. 3.
Figure 4B:
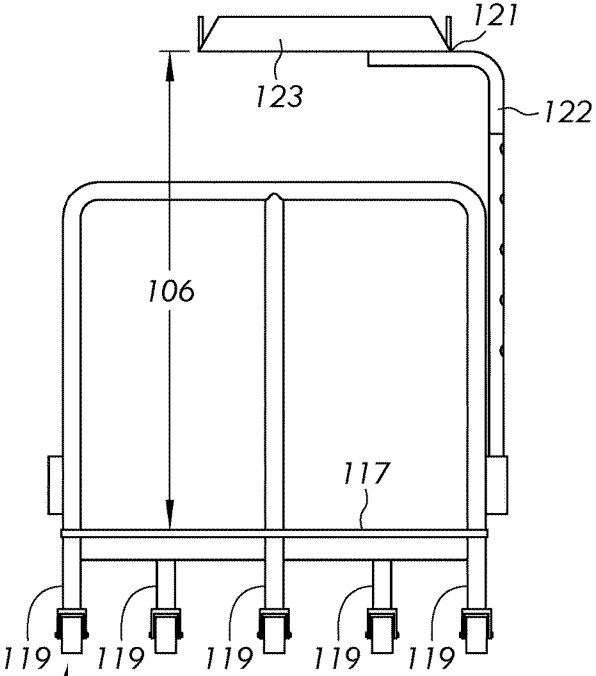
Figure 4A:
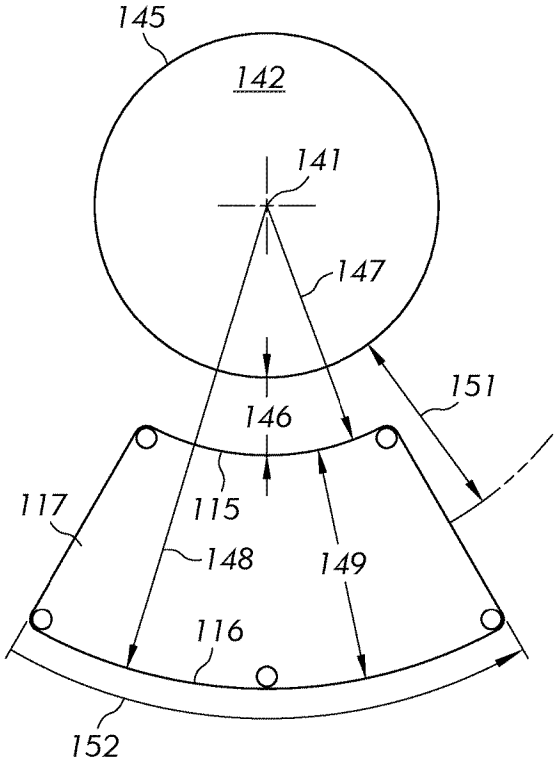

FIGS. 4A-4C show various dimensional views illustrating the utility stand of FIG. 3. In particular, FIG. 4A shows a partial top view (including stylist chair base), FIG. 4B shows a back view, and FIG. 4C shows a right-side view. In this configuration the utility stand 100 includes means for vertically elevating the stylist 110, means for supporting stylist item proximate the stylist while elevated on the stylist stand 120, and means for inhibiting the stylist from inadvertently stepping off the stylist stand 130, which may be configured as a stylist support as well. These elements of utility stand 100 may be independent of each other, integrated together or otherwise combined, or any combination thereof. Moreover, additional elements and features may be integrated together or otherwise combined completely or partially.

As shown in FIG. 4A, the standing surface 117 may provide the stylist greater mobility while elevated and a variety of working positions. In particular, the standing surface 117 may extend about a portion or portions of the stylist chair. Moreover, the standing surface 117 may have a geometric, symmetric, or asymmetric shape configured to provide that the stylist extra strategic space or less surplus space, as needed. For example, as illustrated, the standing surface 117 may have shape of a regular annular section that sweeps through and arc 152 with a radial width 149. It is understood that the standing surface may sweep through an angle without having the actual shape of an annular section. According to embodiments, the radial width 149 may be at least 1 foot, between 1 foot and 3 feet, or approximately 20 inches.

According to one embodiment, the arc 152 may sweep approximately 90 degrees around the chair vertical axis (chair center axis 141) when the utility stand is positioned for use in the work area. In particular, the utility stand 100 may be configured to operate with a stylist chair 142 that rotates (e.g., at least 180 degrees), and, as above the chair center axis 141 also corresponds to its axis of rotation. For example, the utility stand 100 may be fully stationary or quasi-stationary, and rather than have an arc 152 that sweeps substantially the entire work area, it may be limited to a much smaller sweep such that the stylist chair 142 becomes an element of, or at least an aid to, the utility stand 100. Advantageously, the stylist can work on both right and left sides of the clients head while doing foils, perms, cuts etc. without the need to move his/her footing/position. This aspect of the disclosure may be particularly beneficial as the stylist will not have to move the utility stand 100 once in place. Preferably the arc 152 may be a regular annular section, as described above, but other plan shapes are contemplated. Also for example, the standing surface 117 may include a shape that sweeps the arc 152 at least 90 degrees around the chair vertical axis when the utility stand is positioned for use in the work area. Also for example, the standing surface 117 may include a shape or footprint that sweeps the arc 152 between 45 degrees and 180 degrees about the chair vertical axis when the utility stand is positioned for use in the work area. Also for example, the standing surface 117 may include a shape that sweeps the arc 152 between 90 degrees and 240 degrees about the chair vertical axis when the utility stand is positioned for use in the work area.

Moreover, the standing surface 117 may provide a footprint between less than the available work area of the stylist to greater than the available work area. For example, the standing surface 117 may generally shadow the available work area of the stylist, such as an annular region, or section thereof corresponding to arc 152. As described above, the available work area may very broadly include an arm's length distance 151 generally extending around the base 145 of the stylist chair 142.

According to one embodiment, the standing surface 117 may generally shadow a lesser amount of the available work area, such as a portion of the available work area. Here, the portion of the available work area may include an annular arc (through arc 152) that excludes a gap 146 from the outer edge of the base 145 of the stylist chair 142 to front edge 115. For example, the gap 146 may be on the order of a 1 foot gap.

According to another embodiment, the standing surface 117 may generally shadow a lesser and greater amount of the available work area, such as where the back edge 116 of the standing surface 117 coincides with a back radius 148 that extends beyond a working area of the stylist, the front edge 115 of the standing surface 117 extends forward to a front radius 147 (having radial width 149, but which is a distance of gap 146 from the outer edge of the base 145 of the stylist chair 142. For example, the gap 146 may be on the order of a 1 foot gap.

As shown in FIG. 4B, the utility support 121 may include a stylist item support 123, and a support riser 122 configured to hold the stylist item support 123 at desired a utility elevation 106 (i.e., the relative height the stylist would reach for the stylist item). Preferably, the support riser 122 may be configured to be lightweight and easy to move. For example, as shown here, support riser 122 may include a 90 degree thin-walled tube, or other vacated support structure, fixed to the stylist item support 123 (e.g., horizontal tray) and extending downward to provide the desired height or utility elevation 106.

For convenience, and as illustrated, the utility elevation 106 generally may be measured from the standing surface 117 to the tray surface. Using this metric, and according to one embodiment, the utility support 121 may include an extension member (support riser 122) that is configured to elevate the stylist tools or items at least 2 feet above the standing surface 117. According to another embodiment the support riser 122 may be configured to elevate the stylist items between 2 and 3 feet above the standing surface 117. According to yet another embodiment the support riser 122 may be configured to elevate the stylist items approximately 32 inches above the standing surface 117.

According to one embodiment the support riser 122 may be configured to be toollessly adjustable between different elevations or heights. In particular, the support riser 122 may include a plurality of height configurations between 2 and 3 feet above the standing surface 117 where the stylist can reconfigure or otherwise vary the utility elevation 106, without the use of tools (e.g., tube button clips internal to an inner tube and configured to lockably engage an outer, telescoping tube).

As shown in FIG. 4C, the platform 111 may include a standing surface 117 and a platform riser 118 configured to elevate the standing surface 117 to a platform elevation 107. Preferably the platform riser 118 may be configured to be lightweight and easy to move. For example, as shown here, platform riser 118 may include a series of legs 119 fixed to the standing surface 117 and extending downward to provide the desired height or platform elevation 107. It is understood that the height of a particular stylist may vary, and as such the so may the platform elevation 107. As such, the platform elevation 107 may be set to a level which will keep a particular stylist's arms at no more than a 90 degree position through all tasks. According to one embodiment, the platform riser 118 may be configured to elevate the stylist between a range of 6 inches and 18 inches vertically, thus setting the standing surface 117 to a platform elevation 107 of between 6 inches and 18 inches. Likewise, platform elevation 107 may be at least 6 inches.

According to one embodiment, the platform elevation 107 may be variable. In particular, the standing surface may be adjustable between a minimum elevation and a maximum elevation For example, the legs 119 may include telescoping members including a plurality of height settings and corresponding locking devices (e.g., shear pin, threaded extenders, etc.) with plurality of height settings corresponding to at least a first elevation and a second elevation, the first elevation being lower than the second elevation. Further, the first elevation may correspond to a minimum elevation of the standing surface (e.g., platform elevation 107 being approximately 6 inches), and the second elevation may correspond to a maximum elevation of the standing surface (e.g., platform elevation 107 being approximately 18 inches).

In addition, the platform riser 118 may be discretely adjustable between the minimum elevation and the maximum elevation. For example, the telescopic members may include additional height settings between the minimum elevation and the maximum elevation, where the platform elevation 107 can be adjusted by removing the locking device (e.g., shear pin), reconfiguring the telescoping members, and reengaging the locking device. According to one embodiment, the standing surface may be continuously adjustable between the minimum elevation and the maximum elevation.

According to one embodiment, the utility stand 100 may be mobile. In particular, the utility stand 100 may include means to facilitate moving the stylist stand or means for moving the utility stand 160. For example, as illustrated, the utility stand 100 may include a wheel assembly 161 configured to facilitate moving the utility stand. As illustrated, the wheel assembly 161 may include a plurality of wheels attached to each leg. In this way, the entire the utility stand 100 may rolled from one position to another. In some embodiments, the utility stand 100 and/or the wheel assembly 161 may include at least one positioning wheel configured to facilitate moving the utility stand 100. In particular, at least one wheel or a portion of the wheel assembly 161 may rotate about a vertical axis (in addition to rolling about its horizontal axis). In this way, the utility stand 100 may be steerable.

According to one embodiment, the utility stand 100 may include means to inhibit moving the stylist stand once positioned. In particular, the utility stand 100 and/or the wheel assembly 161 may include at least one securing device configured to inhibit or prevent moving the utility stand once set or positioned. For example, where all points of the utility stand 100 that touch the floor include a wheel, the securing device may include at least one of a brake, a wheel lock, an anchor, or their equivalents. Also for example, one more portions (e.g., legs) of the platform 111 may extend to the floor as an anchor. In this way, the stylist may grab a lifting handle or other appropriate surface of the utility stand 100, lift the one more portions in contact with the floor to "release" the anchor. According to one embodiment, the wheel assembly 161 may include a plurality of 2 inch swivel casters with brake.

It should be noted that the utility stand 100 may be arranged as kit 155 including the platform 111, the utility support 121, the back stop 131, the wheel assembly 161, and a set of user instructions 156. The set of user instructions 156 may describe the assembly of the individual kit components and their use, as well as detailing functional relationships and relation together (such that the utility stand 100 can be used, maintained, or the like in a preferred manner). The utility stand 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

Figure 5:
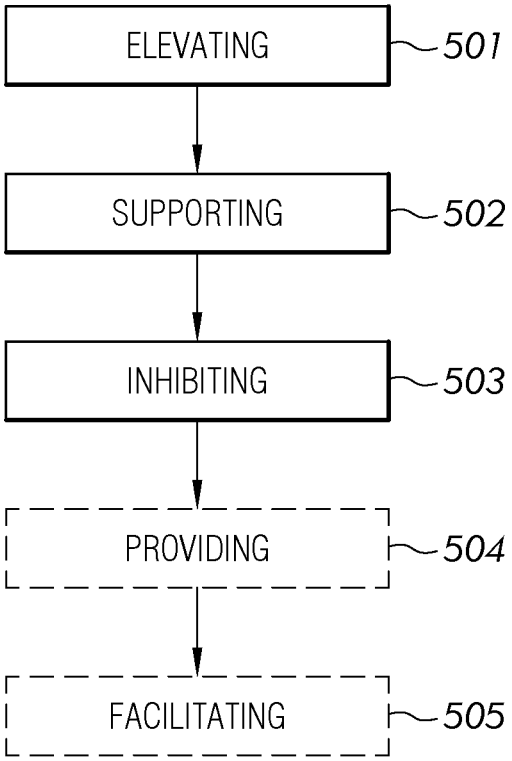
FIG. 5 is a flow diagram illustrating a method for ergonomically assisting a stylist, according to an embodiment of the present disclosure.

FIG. 5 is a flow diagram illustrating a method for ergonomically assisting a stylist, according to an embodiment of the present disclosure. Here, method 500 may be executed with or otherwise implemented with the utility stand 100 of FIGS. 1-4. As shown, method 500 may include the steps of: step one 501, elevating a stylist at least 6 inches vertically; step two 502, supporting stylist item proximate the stylist while elevated; and step three 503, inhibiting the stylist from inadvertently falling or stepping off the support or platform while elevated.

Optionally, method 500 may also include step four 504, providing the stylist with an elevated working area that sweeps at least 90 degrees about a stylist chair. Optionally, method 500 may also include step five 505, facilitating positioning the elevated working area, such as by providing the utility stand 100 with wheels, wheel assemblies, skids, and the like. According to one embodiment, step five 505, facilitating positioning the elevated working area, may also include inhibiting moving the elevated working area once positioned, such as by using wheel locks, anchors, etc.

It should be noted that optional steps of method of use 500 are illustrated using dotted lines in FIG. 5 so as to distinguish them from the other steps of method of use 500. It should be noted that the steps described in the flow diagram can be carried out in many different orders, according to user preference. The use of "step of" should not be interpreted as "step for", in the claims herein and is not intended to invoke the provisions of 35 U.S.C. § 112(f).

The stylist stand and method for assisting a stylist disclosed herein may provide many benefits. The stylist may have the ability to perform at a more comfortable level, creating less damage to these various parts with better body mechanics. This is particularly the case when elevating the working level for shorter stylists (5 ft and under) whom regularly perform prolonged and repetitive hair practices on clients. With the utility stand 100 of FIGS. 1-4., the shorter stylist may now be working at a 12 inch raised level which will keep their arms at a 90 degree position as opposed to 45 degrees overhead. Advantageously, the stylist may be able to complete more services in their working day without the discomfort of pain, positively affecting their productivity, and creating a better work environment both physically and emotionally. Furthermore, this may be cost effective for both employers and the employee, as stylists often require physical therapies or time off due to injuries.

Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The present disclosure may provide for significant improvements and serve as a stylist stand and method for assisting a stylist. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein.

The embodiments of the invention described herein are exemplary and numerous modifications, variations and rearrangements can be readily envisioned to achieve substantially equivalent results, all of which are intended to be embraced within the spirit and scope of the invention. For purposes of summarizing the disclosure, certain aspects, advantages, and novel features of the invention have been described herein. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A utility stand system for a work area about a stylist chair, the stylist chair having a chair vertical axis and the work area surrounding and extending radially outward from the stylist chair vertical axis, the utility stand system comprising:

a) a utility stand comprising:
  i) a platform comprising:
    (1) a stylist elevator; and
    (2) a standing surface comprising a front edge and a back edge;
  ii) a utility support comprising;
    (1) a utility support vertical axis;
    (2) a utility support riser;
    (3) a right utility support interface;
    (4) a left utility support interface; and
  iii) a back stop; and
b) a positioning wheel;
c) wherein said stylist elevator is structured and arranged with said standing surface to vertically elevate the stylist, while providing the stylist with freedom-of-movement within said platform, when the stylist is in at least a portion of the work area around the stylist chair;
d) wherein said utility support is structured and arranged with said platform to rotate about said utility support vertical axis;

e) wherein said platform includes said standing surface configured to elevate the stylist between 6 inches and 18 inches vertically;

f) wherein said positioning wheel is structured and arranged with said platform to rollingly-position said utility stand on a floor; and g) wherein said standing surface sweeps between 45 degrees and 180 degrees about the chair vertical axis when said utility stand is positioned for use in the work area.

2. A stylist utility stand system comprising:

a) a stylist elevator structured and arranged with a platform for vertically elevating a stylist while in a work area about a stylist chair;

b) a utility stand back stop mechanically structured and arranged with said platform for inhibiting the stylist from inadvertently stepping off the platform for vertically elevating a stylist; and c) a stylist tools and supplies support structured and arranged with a utility support riser for supporting stylist tools and supplies proximate the stylist while the stylist is elevated on said stylist elevator;

d) wherein said stylist elevator comprises a standing surface configured to elevate the stylist at least 6 inches vertically;

e) wherein said stylist tools and supplies support comprises an extension member configured to elevate the stylist tools and supplies at least 2 feet above the standing surface; and f) wherein said standing surface sweeps at least 90 degrees around the stylist chair.

3. The stylist utility stand system of claim 2, wherein, relative to a view point of the stylist facing towards the stylist chair when standing on the standing surface, said standing surface further includes a right-hand-side and a left-hand-side, separated by a centerline of the standing surface; and a) wherein the utility support riser for supporting the stylist tools and supplies proximate the stylist further includes a right utility support interface and a left utility support interface, each configured to position the stylist tools on at least one of the right-hand-side or the left-hand-side of the centerline, respectively.

* * * * *